US005356256A

United States Patent [19]

Turner et al.

[11] Patent Number: 5,356,256

[45] Date of Patent: Oct. 18, 1994

[54] REFORMED CONTAINER END

[76] Inventors: Timothy L. Turner, 5704 Greenview Rd., Cary, Ill. 60013; Dennis Dettmer, 126 N. Columbia St., Naperville, Ill. 60540; Randall G. Forrest, 1205 Monarch La., Hoffman Estates, Ill. 60195

[21] Appl. No.: 955,921

[22] Filed: Oct. 2, 1992

[51] Int. Cl.[5] ..... B21D 51/44

[52] U.S. Cl. ..... 413/8; 72/348

[58] Field of Search ..... 413/1, 8, 11; 72/348

[56] References Cited

U.S. PATENT DOCUMENTS

| | | | |
|---|---|---|---|
| 2,017,460 | 10/1935 | Hothersall | 113/121 |
| 2,047,830 | 7/1936 | Lofts | 113/15 |
| 3,259,267 | 7/1966 | Bozek et al. | 220/54 |
| 3,417,898 | 12/1968 | Bozek et al. | 220/66 |
| 3,843,014 | 10/1974 | Cospen et al. | 220/66 |
| 3,907,152 | 9/1975 | Wessely | 220/66 |
| 3,945,334 | 3/1976 | Ostrem et al. | 113/121 |
| 3,957,005 | 5/1976 | Heffner | 113/1 F |
| 4,031,837 | 6/1977 | Jordan | 413/8 |
| 4,036,160 | 7/1977 | Kelley | 113/121 |
| 4,093,102 | 6/1978 | Kraska | 220/67 |
| 4,109,599 | 8/1978 | Schultz | 113/121 |
| 4,129,085 | 12/1978 | Klein | 113/121 |
| 4,217,843 | 8/1980 | Kraska | 113/121 |
| 4,408,698 | 10/1983 | Ballester | 220/306 |
| 4,448,322 | 5/1984 | Kraska | 220/67 |
| 4,559,801 | 12/1985 | Smith et al. | 72/348 |
| 4,571,978 | 2/1986 | Taube et al. | 72/349 |
| 4,587,816 | 5/1986 | Bulso, Jr. . | |
| 4,587,825 | 5/1986 | Bulso, Jr. . | |
| 4,641,761 | 2/1987 | Smith | 413/8 |
| 4,704,887 | 11/1987 | Bachmann et al. | 72/347 |
| 4,713,958 | 12/1987 | Bulso, Jr. et al. | 72/348 |
| 4,715,208 | 12/1987 | Bulso, Jr. et al. | 72/348 |
| 4,790,705 | 12/1988 | Wilkinson et al. | 413/8 |
| 4,809,861 | 3/1989 | Wilkinson et al. | 220/66 |
| 4,903,521 | 2/1990 | Bulso, Jr. . | |
| 4,928,884 | 5/1990 | LaBarge | 220/207 |
| 4,934,168 | 6/1990 | Osmanski | 72/348 |
| 4,955,223 | 9/1990 | Stodd et al. | 72/336 |
| 4,977,772 | 12/1990 | Bulso, Jr. et al. | 72/336 |
| 4,991,735 | 2/1991 | Biondich | 220/600 |
| 5,042,284 | 8/1991 | Stodd et al. | 72/329 |
| 5,046,637 | 9/1991 | Kysh | 220/610 |
| 5,149,238 | 9/1992 | McEldowney | 413/8 |

*Primary Examiner*—Jack W. Lavinder

*Attorney, Agent, or Firm*—Wallenstein, Wagner & Hattis, Ltd.

[57] ABSTRACT

A method of reforming a countersink (14) of a container end (10) from a shell (10') is disclosed. A shell (10') is provided having a center panel (12') including an initial panel height (A') and an initial panel diameter (D'). The shell further has an integral countersink (14') including an initial countersink depth (A'), an inner wall (30') and an outer wall (32') being joined by a curved countersink bottom (34'). The bottom has an initial bottom radius (R1). The panel (12') is joined to the inner wall (30') of the countersink by a curved shoulder (36') having an initial shoulder radius (R2'). The shell is reformed by decreasing the panel height, increasing the panel diameter and decreasing the countersink depth. The reformed shell (14'') is further reform by increasing the panel height and further decreasing the countersink depth.

4 Claims, 4 Drawing Sheets

REFORMED CONTAINER END

DESCRIPTION

1. Technical Field

The present invention relates generally to closures for containers and more particularly to a metal end wall type closure for a beer or beverage container converted from a blank and reformed to a structure with improved strength.

2. Background Prior Art

The packaging industry is continually looking for ways to reduce the amount of material used in a package while improving or maintaining the integrity and functionality of the package. This is of particular importance in the area of beer and beverage containers due to extremely high volumes. With such large volumes, small reductions in the materials used for each package adds up to a very significant savings of money and of metal resources.

One area where a great deal of work has been done to reduce material costs is the generally flat end wall closing of a conventional, generally cylindrical container. As is well known, this end wall, or container end, is less able to withstand internal pressurization of the container than the side wall for a given gauge of metal. Thus, for example, while the industry has been able to reduce the side wall of a two-piece aluminum beer and beverage container to about 0.004" in gauge thickness, the container end is on the order of 0.011" to 0.012" depending on the container end's intended purpose and design. Reduction in the gauge of a container end of a beer or beverage container of a few thousandths of an inch will result in large raw material savings.

The container end typically has a center panel surrounded by a chuck wall which is integrally connected to a peripheral flange or curl. Internal pressurization of the container can cause the center panel on the container end to dome, or bulge, upwardly due to axial upward forces. The axial upward forces acting on the center panel result, in turn, in radially inward forces being applied to the chuck wall which is positioned on the inner surface of the side wall. The curl is provided to double-seam the container end to the container. Thus, the chuck wall may be pulled away from the side wall allowing the center panel to bulge even higher. A variety of problems are encountered if the center panel rises above the double seam of the container. Historically, this has been compensated for by utilizing a relatively thick container end. However, in order to thin the container end, an improved container end design was needed in order to help the container end withstand bulging and buckling forces.

U.S. Pat. No. 3,417,898 to Bozek et. al., discloses an early development in this area. Specifically, Bozek et. al., discloses provision of a countersink area between a center panel of the container end and a peripheral curl used to secure the end to a container. The container end of Bozek et. al., was formed in a two-stage operation. The container end was initially drawn to be relatively deep and to include a side wall (or chuck wall) integral with a peripheral curl. The side wall was integrally connected by a segment having a large radius to a relatively flat recessed central panel. In a subsequent operation, the recessed panel is moved axially upwardly and the segment with the large radius is deformed together with a lower portion of the side wall to form an inner side wall, a sharp bend (typically referred to as a countersink bottom) and an outer side wall. In an alternative embodiment, a third operation is subsequently performed which increases the arc of the bend and causes the inner wall to flare radially outward so that the upper portion of the inner wall is brought into contact with the outer side wall.

Since Bozek et. al., considerable work has been done to improve the buckle strength of a container end through modification of the countersink area usually in concert with other structural elements of the container end. The conventional practice in making a container end today is to start with a shell that includes a countersink portion between the center panel and the curl. The shell is made in a shell press for converting a disk of metal, or cut-edge, into a shell. The shell is then processed in a conversion press, where the shell undergoes various operations to be converted to a finished container end. For example, a ring pull or non-detachable tab is attached to the end, and score lines are provided for a pour hole. A container end maker may purchase standard shells from a vendor or operate its own shell presses.

The structural design of a container end can be advantageously used to reduce the material required to produce the container end. Improved strength resulting from an improved structural design will compensate the container end for loss of strength due to reduction in gauge thickness.

Of course, reduction of materials in the container end is limited by the performance required of the packaging. For example, beer and beverage containers must be able to withstand internal pressurization, mechanized seaming and handling processes, and shipping. In large part, the industry has established minimum standards to ensure performance. For example, a container end must be able to withstand 90 to 93 psig internal pressure without permanent deformation such as buckling. These pressure levels may be experienced during pasteurization of the filled product after the container is sealed.

Material reduction by structural redesign modification is also limited by industry requirements. For example, in the beer and beverage container industry, container ends are required to meet certain dimensional specifications so that the ends will fit on containers made by any vendor and so that the ends are compatible with standard equipment for attaching the ends to the containers.

Material reduction by structural redesign is also limited by the fact that it is expensive to shut down and modify the high-speed precision tooling required to make container ends. This limitation is multiplied by the large number of machines required to produce the high volume of containers produced in a year.

SUMMARY OF THE INVENTION

The present invention provides for an improved strength container end by reforming a conventional shell. Use of the conventional shell provides a savings in retooling costs and provides that existing shell tooling may be used to produce shells for other types of ends as well as ends of the present invention. This also provides that existing cutedge radial dimensions can be retained. The improved strength provides a lower failure rate as the added strength can compensate for other failure factors such as nonuniform metal. Alternatively, the added strength of the end permits down-gauging of the metal while meeting industry standard buckle and rock resistance. However, as the metal is down-gauged, it becomes increasingly difficult to form an improved strength end without thinning or tearing portions of the end. The present invention provides a method which can be utilized to rapidly form reduced metal ends without substantially thinning or tearing portions of the ends during formation thereof.

Specifically, the present invention provides for a method of reforming a standard shell in a conversion press. The standard shell has a center panel surrounded by an integral countersink. The center panel includes an initial panel height and an initial panel diameter. The integral countersink includes an initial countersink depth, an inner wall and an outer wall having an initial distance and angle between them and joined by a curved countersink bottom having an initial bottom radius. The center panel is joined to the inner wall of the countersink by a curved shoulder having an initial shoulder radius. The outer wall is joined to a peripheral flange, or curl, having an initial curl diameter.

The method includes reforming the countersink portion of the shell while maintaining the initial curl diameter constant in a first operation. The countersink portion is then further reformed in a second operation while, again, maintaining the initial curl diameter constant. Accordingly, the final curl diameter of the container end is equal to the initial curl diameter of the shell. The initial curl diameter is preferably maintained by gripping or holding a portion of the outer wall of the countersink fixedly in place during the first and second operations.

In another aspect of the invention, the method includes providing a standard shell to be reformed. The shell is reformed by decreasing the panel height, increasing the panel diameter, and decreasing the countersink depth in a first operation. The shell is further reformed by increasing the panel height and further decreasing the countersink depth in a subsequent operation. The panel diameter may be kept constant during the further reforming operation.

During the further reforming step, the panel height is preferably increased to a value greater than the initial panel height. Additionally, the reforming step may include decreasing the shoulder radius.

The reforming step may include decreasing the countersink bottom radius and the further reforming step may include decreasing the countersink bottom radius. Additionally, the reforming step may include reforming the initial countersink bottom radius into a first countersink bottom radius and a second countersink bottom radius and the further reforming step includes reforming the first countersink bottom radius and the second countersink bottom radius into a single predetermined countersink bottom radius. The first countersink bottom radius may be smaller than the second countersink bottom radius. Also, the first countersink bottom radius may be equal to the predetermined countersink bottom radius.

In a preferred aspect of the invention, the initial countersink bottom radius of the shell is about 0.020" to 0.030", the first countersink bottom radius is about 0.010", the second countersink bottom radius is about 0.020" and the predetermined countersink bottom radius is also about 0.010".

In yet another aspect of the invention, the method includes decreasing the angle between the inner wall and the outer wall of the countersink in the reforming step and decreasing the angle between the inner wall and the outer wall of the countersink in the further reforming step. This is preferably done while decreasing the shoulder radius such that the inner wall is straightened to a more perpendicular position with respect to the center panel.

The method may also include decreasing the distance between the inner wall and the outer wall during the reforming step and decreasing the distance between the inner wall and the outer wall during the further reforming step.

The shell also includes an initial countersink diameter and the reforming step may include increasing the countersink diameter. The further reforming step may also include decreasing the countersink depth.

The shoulder of the center panel may also be coined to provide extra buckle strength as is known in the art. This is preferably done in the further reforming step.

In accordance with still another aspect of the present invention, a method of reforming a shell is disclosed. The method includes providing a shell to be reformed. The shell is then subjected to a first reforming operation which reforms the countersink bottom and the inner wall by moving metal from a portion of the countersink bottom into the inner wall such that the distance from the inner wall and the outer wall is decreased. The first reforming operation also reforms the inner wall and the center panel by moving metal from the inner wall into the center panel such that the center panel diameter is increased. According to one aspect of the invention, the decrease in panel height due to reforming a portion of the inner wall into the center panel is greater than the increase in panel height due to reforming a portion of the countersink bottom into the inner wall such that the overall panel height decreases during the first reforming operation.

A further, or second reforming operation may be performed which further reforms the countersink bottom and the inner wall by moving metal from a portion of the countersink bottom into the inner wall such that the panel height is increased and the distance between the inner wall and the outer wall is decreased.

Again, the first reforming of the countersink bottom and the inner wall may include reforming the initial countersink bottom radius into a first countersink bottom radius and a second countersink bottom radius. Additionally, the further reforming step may include reforming the first and second countersink bottom radii into a single predetermined countersink bottom radius.

In accordance with yet another aspect of the present invention, another method of reforming a shell is disclosed. The method includes providing a shell to be reformed and providing a first tool adapted to engage a portion of the upper surface of the shell. The first tool having opposed inner and outer work surfaces, the inner and outer work surfaces co-terminating in a first arcuate nose having a first nose radius. The first arcuate nose is positioned between the inner and outer walls of the shell at a predetermined distance from the countersink bottom. A portion of the outer wall is secured to the outer work surface. The countersink bottom is caused to wrap around the first arcuate nose while maintaining the secured portion of the outer wall in a fixed position and causing at least a portion of the inner wall to move against the inner work surface in a manner to decrease the countersink depth and to define an intermediate inner and outer wall and an intermediate countersink bottom having an intermediate radius.

The method may further include providing a second tool adapted to engage a portion of the upper surface of the shell, the second tool having opposed inner and outer work surfaces, the inner and outer work surfaces co-terminating in a second arcuate nose having a second nose radius. The second arcuate nose is positioned between the intermediate inner and outer walls of the shell at a predetermined distance from the intermediate countersink bottom. A portion of the intermediate outer wall is secured to the outer surface of the second tool. The countersink bottom is caused to wrap around the second arcuate nose while maintaining the secured portion of the outer wall in a fixed position and causing at least a portion of the intermediate wall to move against the inner surface of the second tool in a manner to further decrease the countersink depth and to form a final countersink bottom having a final radius. Preferably, the final radius is about 0.010".

The second tool may optionally include an annular angled segment integral with the inner work surface and positioned radially inward from the inner work surface. The annular angled segment is adapted to coin a portion of the shoulder.

The countersink bottom may be caused to wrap around the first arcuate nose by engaging a portion of the lower surface of the shell radially inward of the first arcuate nose with a first lower tool and causing the first lower tool to move axially upward relative to the shell. Similarly, the intermediate countersink bottom may be caused to wrap around the second arcuate nose by engaging a portion of the lower surface of the shell radially inward of the second arcuate nose with a second lower tool and causing the second lower tool to move axially upward relative to the shell.

Other features of the invention are described in the specifications and claims to follow and, in some cases, shown in the drawings.

DETAILED DESCRIPTION OF A PREFERRED EMBODIMENT

Figure 1:
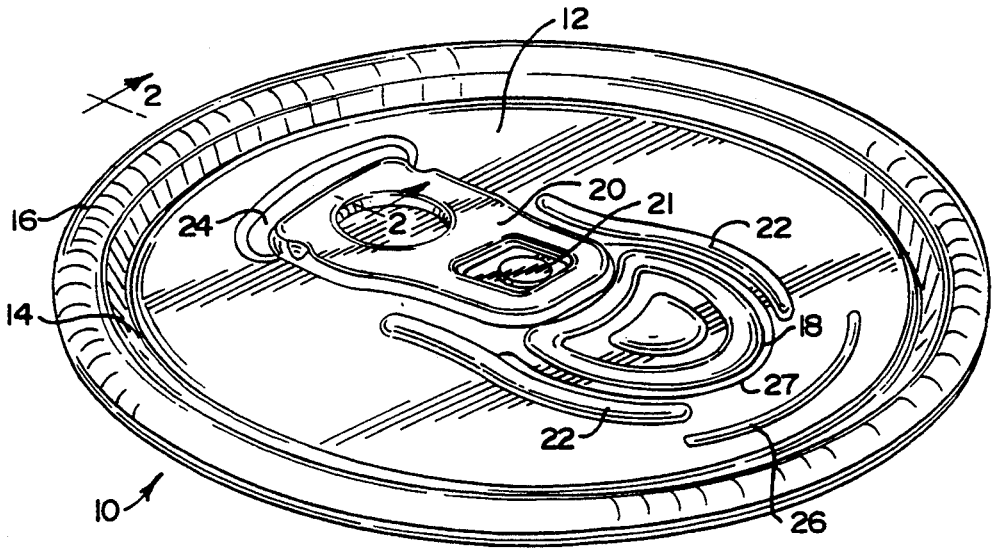
FIG. 1 is a perspective view of a container end of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

In particular, the preferred embodiment will be described in terms of forming a 206 container end (i.e. a container end for a container having a 2 6/16 inch neck); however, the invention is not limited to a container end for this particular neck dimension.

FIG. 1 discloses a top perspective view of a completed container end 10 of the present invention. The container end 10 includes a generally flat, circular center panel 12 integrally connected to a circumferential countersink 14. The countersink 14 is integrally connected to a circumferential peripheral flange or curl 16. The curl 16 is of conventional dimension and used to conventionally seam the container end 10 to a container (not shown). The center panel 12 of the container end 10 also includes score lines 18 which define a pour opening and a nondetachable tab 20 conventionally secured to the center panel 12 by a rivet 21. The tab 20 is lifted to break the pour opening along the score lines 18. The container end 10 further includes ridgelike embossments 22 positioned along the sides of the pour opening defined by the score lines 18, and along a portion of the tab 20. The center panel 12 also includes a fingerwell indentation 24 positioned at the top of the tab 20.

According to one aspect of the invention, the container end 10 includes a coined arcuate segment 26 positioned near the bottom, or nose 27, of the pour opening defined by the score lines 18.

Figure 2:
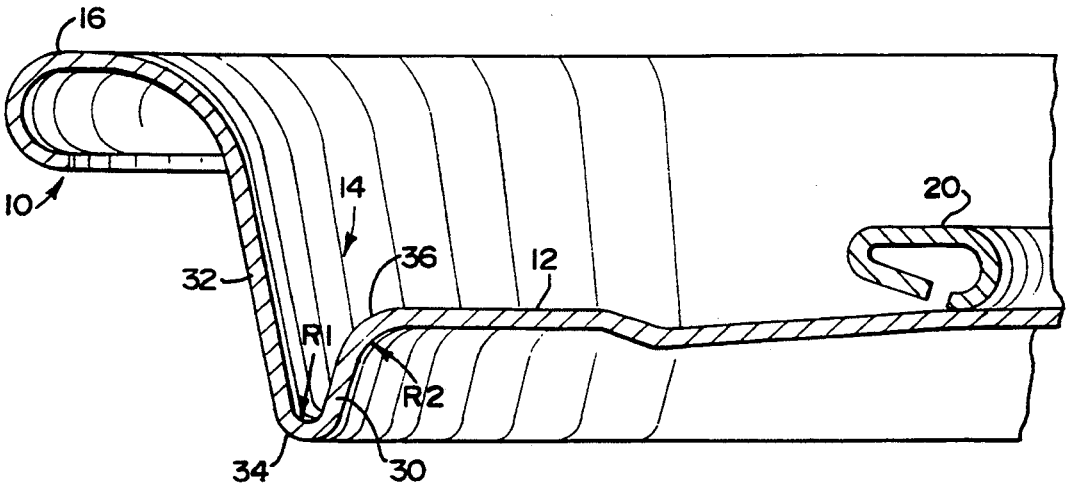
FIG. 2 is a partial perspective cross-sectional view of the container end taken along the line 2—2 of FIG. 1.

The countersink 14, shown in greater detail in FIG. 2, has a generally U-shaped cross-section and includes an inner wall 30 and a generally frustoconical outer wall 32. The inner and outer walls 30,32 are both connected by an arcuate countersink bottom 34. The inner wall 30 is also integrally connected to the center panel 12 by a panel shoulder 36. The outer wall is integrally connected to the curl 16, which has a generally C-shaped cross section and which extends radially outwardly from the outer wall 32.

The countersink bottom 34 has a radius R1. The panel shoulder has a radius R2. According to one aspect of the invention, R1 is less than 0.020". According to another aspect of the invention, R1 is approximately 0.010".

Figure 3:
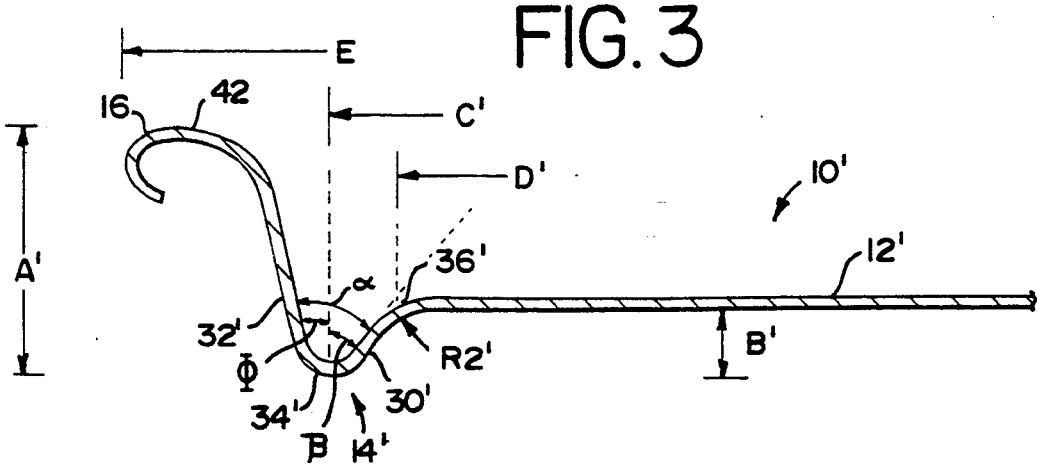
FIG. 3 is a cross-sectional view of a conventional blank or shell.

The container end 10 has a countersink depth A and a panel height B, as illustrated in FIG. 3. The countersink bottom has a diameter C. The center panel 12 has a diameter D, and the curl has a diameter E.

The preferred dimensions of the container end 10 are:

| | | |
|---|---|---|
| Countersink depth | A | .250 (inches) |
| Panel height | B | .078 |
| Countersink diameter | c | 2.133 |
| Panel diameter | D | 2.066 |
| Curl diameter | E | 2.555 |
| Countersink bottom radius | R1 | .010 |
| Shoulder radius | R2 | .035 |

SHELL

The container end 10 is formed from a blank, or cutedge, (not shown), having an industry standard diameter. However, due to the increased resistance to buckle and bulge pressures provided by the structure of the container end 10, the cutedge may be made of a thinner gauge metal, preferably an aluminum alloy, while still meeting industry standard pressure requirements. The gauge of the cutedge may be as low as 0.0105".

Primed numbers will be used in reference to the shell and the first reforming operation. Double primed numbers will be used in reference to the shell after it has been subjected to the first reforming operation. Like numbers will correspond to like elements of the container end 10.

The cutedge is subjected to a conventional first forming operation to form a basic end, or shell 10', shown in FIG. 3. The shell 10' includes a center panel 12' having an initial diameter D', connected to a circumferential countersink 14' having an inner wall 30', an outer wall 32' and a countersink bottom 34' connecting the inner and outer walls 30', 32'. The countersink 14' has an initial countersink diameter C' measured from the middle of the countersink bottom 34', through the center of the center panel 12'. The inner wall 30' of the countersink 14' is connected to the center panel 12' by shoulder 36' having an initial radius R2'. The outer wall 32' is connected to a circumferential curl 16 having an initial diameter E' and a generally C-shaped cross-section. The cross-sectional shape and diameter of 'the curl 16 remain essentially unchanged during the reforming operations described below.

The shell 10' has an initial panel height B', measured from the countersink bottom 34' to the center panel 12', and an initial countersink depth A', measured from the countersink bottom 12' to the uppermost portion 42 of the curl 16. The inner wall 30' and the outer wall 32' have an initial angle $\alpha$ between them. Also, the inner wall has an initial angle $\beta$ with respect to the axis of the container end 10. Similarly, the outer wall 32' has an initial angle $\Phi$ with respect to the axis of the container end 10. The angle $\Phi$ remains constant throughout the reforming operations.

To reach the final container end 10 configuration shown in FIGS. 1 and 2, the shell 10' is subjected to two reforming operations. These reforming operations are preferably performed in a conversion press having a plurality of substations. In addition to the countersink reforming operations, the conversion press may also subject the shell to a variety of additional operations. The reforming operations need not be at any particular substation; however, it is important that the first reforming operation precede the second reforming operation.

The preferred dimensions of the shell are:

| | | |
|---|---|---|
| Countersink depth | A' | .265 (inches) |
| Panel height | B' | .072 |
| Countersink diameter | C' | 2.093 |
| Panel diameter | D' | 1.996 |
| Curl diameter | E' | 2.555 |
| Countersink bottom radius | R1' | .030 |
| Shoulder radius | R2' | .060 |

FIRST REFORM

FIGS. 6–9 disclose progressively the first reforming of the shell 10' as a first die 46 and punch 48 come together. The die 46, which engages portions of the bottom surface of the shell 10' comprises an annular die ring 50 and a die core 52 having a generally flat circular surface 54 and an arcuate shoulder 56 having a radius R3 along the periphery of the circular surface 54. The arcuate shoulder 56 connects the circular surface 54 to a cylindrical surface 57. The circular surface 54 of the die core 52 has a diameter F' which is greater than the diameter D' of the center panel 12' of the shell 10'.

The punch 48, which engages portions of the upper surface of the shell, comprises a circular punch core surface 62 and an annular downwardly projecting nose 64. The projecting nose 64 includes an outer work surface 66 and an inner work surface 68 connected by a bottom work surface 70. The bottom work surface 70 includes a first arcuate working surface 72 having a radius R4 connected to a second arcuate working surface 74 having a radius R5. The radii R4 and R5 form a compound radius. According to one aspect of the invention, the radius R4 of the first arcuate working surface 72 is the same as the countersink bottom radius R1 of the completed container end 10.

The annular die ring 50 engages a portion of the outer wall 32' of the countersink 14' slightly above the countersink bottom 34'. Simultaneously, the outer work surface 66 of the projecting nose 64 engages the upper surface of the shell 10' along a portion of the outer wall 32' slightly above the countersink bottom 34'. As shown in the progression of FIGS. 6–9, the die ring 50 and the outer surface 66 of the downwardly projecting nose 64 cooperate in a manner such that a portion 78 of the outer wall 32' is gripped or held securely between the die ring 50 and the outer working surface 66 throughout the first reforming operation. Thus, the secured portion 78 of the outer wall 32' and the portion of the shell extending radially outward from the secured portion 78 remain essentially unchanged during the first reforming operation.

The shoulder 56 of the die core 52 initially engages a portion of the countersink 14' between the countersink bottom 34' and the inner wall 30'. The shoulder 56 preferably tangentially engages the shell such that metal is moved during the reforming operation without substantially thinning. An annular unrestricted area 80 is located below the countersink bottom 34' of the shell 10'. This allows metal in a portion of the countersink bottom 34' to freely form as the die core 52 rises and forces the countersink bottom 34' to wrap around the downwardly projecting nose 64 of the punch 48.

Figure 7:
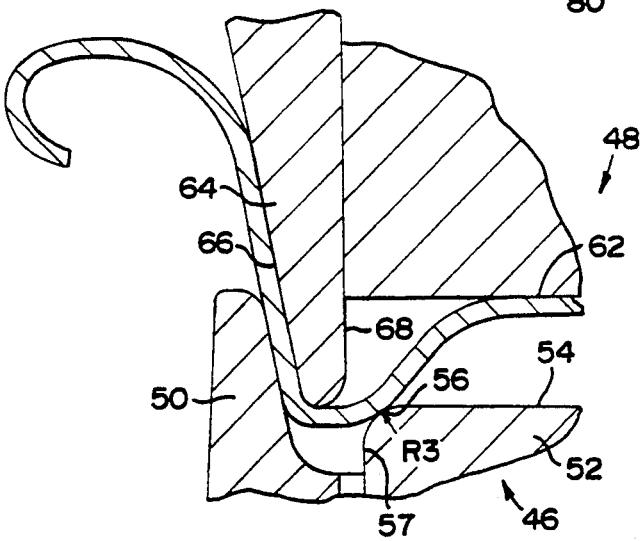
Figure 8:
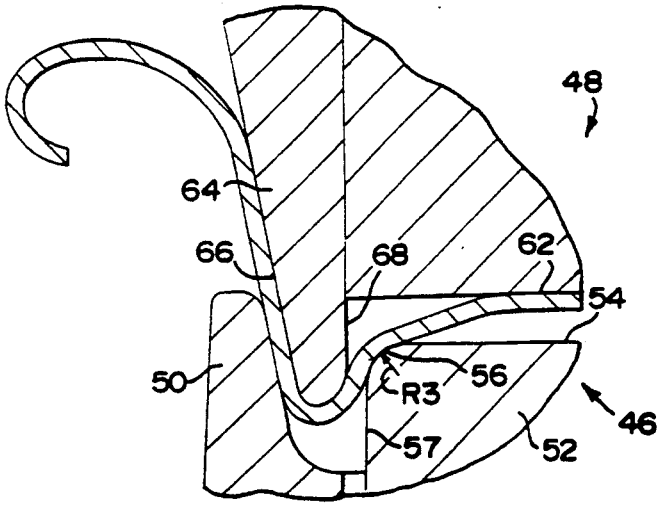
Figure 9:
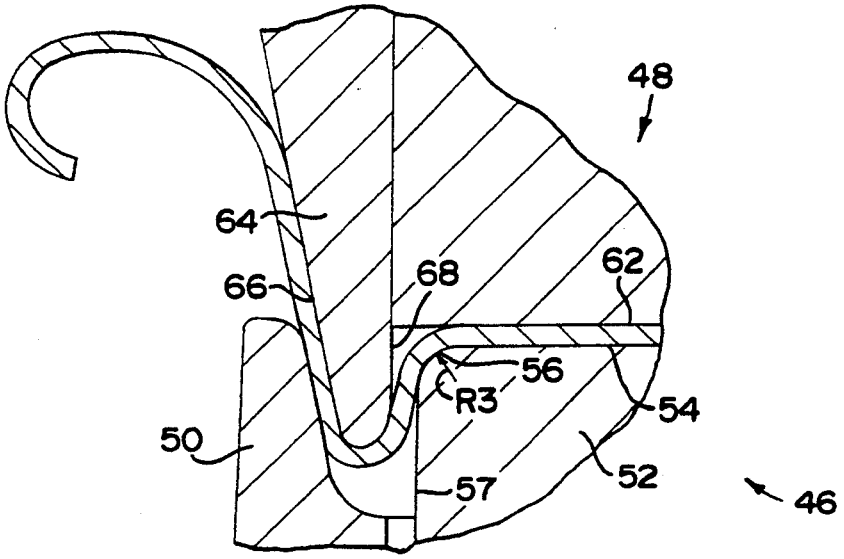

Referring to FIG. 7, the shell 10' is shown partially reformed as the die core 52 is moved axially upward in relation to the die ring 50 and punch 48. FIG. 8 shows further progression of the die core 52 and FIG. 9 shows the final progression of the die core 52. As seen in the progression from FIG. 6 to FIG. 9, the die core 52 forces the countersink bottom 34' to wrap around the arcuate working surfaces 72,74 of the projecting nose 64 and forces a portion of the inner wall 30' against the inner surface 68.

In this manner, a portion of the metal from the countersink bottom 34' is reformed into the inner wall 30'. Also, since the diameter F of the circular surface 54 of the die core 52 is greater than the diameter D' of the center panel 12' of the shell 10'm as the die core 52 is moved axially upward, a portion of the metal from the inner wall 30' is reformed into the center panel 12' increasing the panel diameter D'.

Increasing the panel diameter D' while securely holding the outer wall 32' stationary has an effect of decreasing the distance between the inner wall 30' and the outer wall 32' of the countersink 14'. This also moves the inner wall into a more vertical position, which decreases the angle $\alpha$ between the inner wall 30' and the outer wall 32' and the angle $\beta$ between the inner wall 30' and the axis.

Moving metal from the countersink bottom 34' to the inner wall 30' has the effect of increasing the panel height B' of the shell 10'; however, moving metal from the inner wall 30' to the center panel 12' has the effect of decreasing the panel height B' (while increasing the panel diameter D'). According to the embodiment described, the decrease in panel height resulting from reforming a portion of the inner wall 30' into the center panel 12' is greater than the increase in panel height resulting from reforming a portion of the countersink bottom 34' into the inner wall 30'. Accordingly, the overall panel height is decreased in the first reforming operation. However, by adjusting the diameter of the surface 54 of the die core 52, it is possible to either maintain or increase the panel height in the first reforming step.

Figure 4:
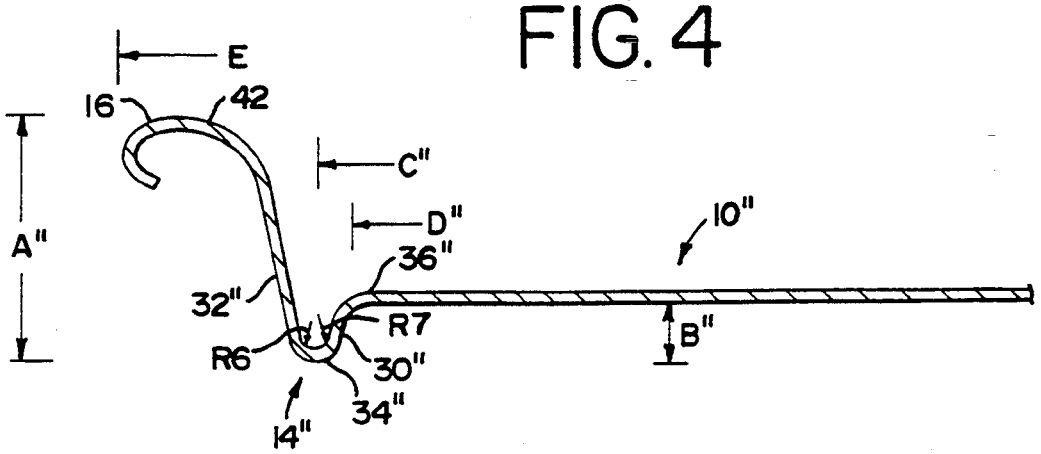
FIG. 4 is a cross sectional view of a conventional blank or shell after a first reforming operation in accordance with the invention.

As the countersink bottom 34' wraps around the arcuate working surfaces 72,74 of the projecting nose 64, it is reformed into the reformed countersink bottom 34" shown in FIGS. 4 and 9. The reformed countersink bottom 34" includes a first arcuate portion having a radius R6 corresponding to the radius R4 of the first arcuate working surface 72, and a second arcuate portion having a radius R7 corresponding to the radius R5 of the second arcuate working surface 74.

The first reforming operation causes the countersink depth A' to decrease. This occurs because the outer wall 32' is secured slightly above the countersink bottom 34' and the countersink bottom 34' is forced upward to wrap around the nose 64 of the punch 48. Also, the first reforming operation causes the countersink diameter C' to increase.

During the first reforming operation, the shoulder 36' is reformed to have a radius R2" corresponding to the radius R3 of the shoulder 56 of the die core 52.

FIG. 4 shows a cross-sectional view of a reformed shell 10" after completion of the first reforming operation.

The preferred dimensions of the reformed shell 10" are:

| | | | |
|---|---|---|---|
| Countersink depth | A" | .258 | (inches) |
| Panel height | B" | .064 | |
| Countersink diameter | C" | 2.133 | |
| Panel diameter | D" | 2.066 | |
| Curl diameter | E" | 2.555 | |
| Countersink bottom radius | R6 | .010 | |
| | R7 | .020 | |
| Shoulder radius | R2" | .035 | |

SECOND REFORM

Figure 5:
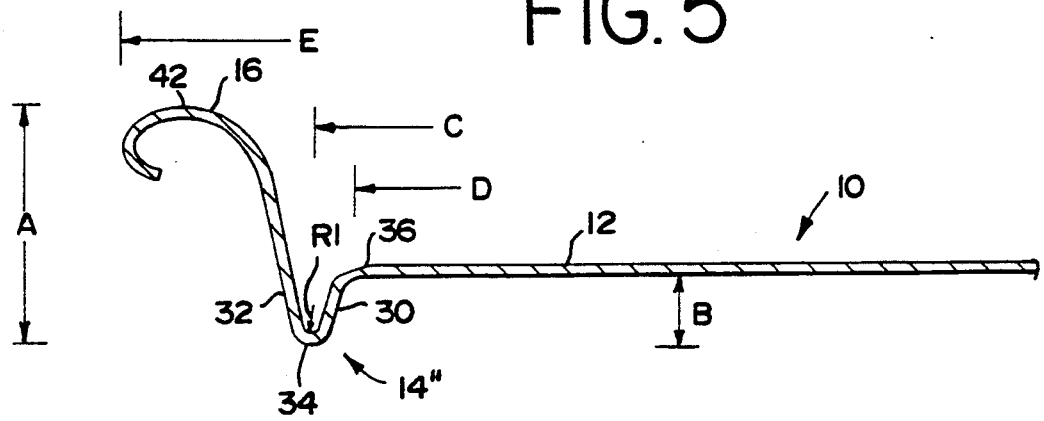
FIG. 5 is a cross sectional view of a container end after a second reforming operation in accordance with the invention.
Figure 6:
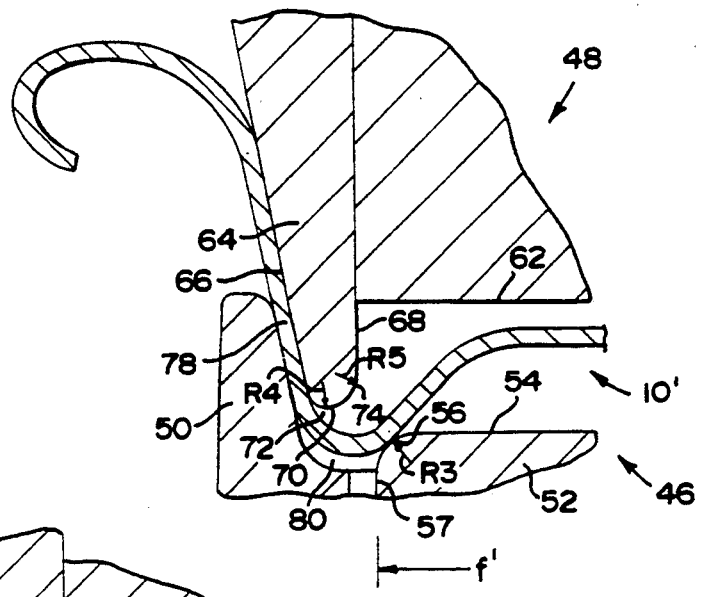
FIGS. 6–9 disclose progressively the first reforming operation in accordance with the present invention.
Figure 10:
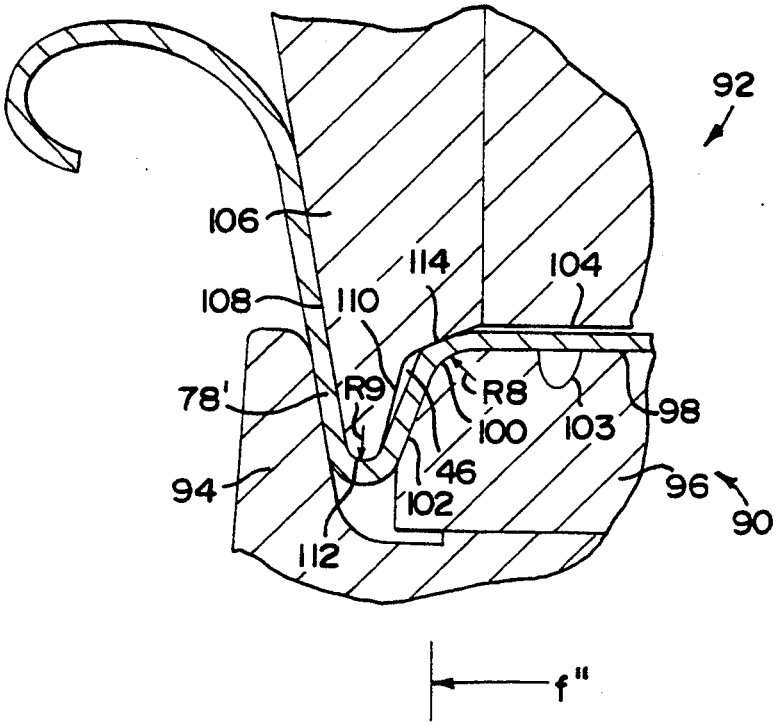
FIG. 10 discloses the second reforming operation in accordance with the present invention.

The reformed shell 10" is subjected to a second reforming operation shown in FIG. 10. As discussed below, in addition to further reforming the countersink 14" of the reformed shell 10", the second reforming operation, in a preferred aspect of the invention, may be utilized to thin or work harden the metal in an annular segment (i.e. coin) on the shoulder 36" of the reformed shell 10". However, this may be performed in a separate substation of the conversion press or may be omitted altogether. A cross-sectional view of a container end 10 having the coined shoulder 36 is shown in FIG. 5.

In the second reforming operation shown in FIG. 10, a second die 90 and punch 92 are brought together to further reform the reformed shell 10" into a completed container end 10. The die 90 comprises an annular die ring 94 and a die core 96. The die core 96 includes a central circular working surface 98, an annular arcuate working surface 100 having a radius R8 disposed along the periphery of the circular working surface 98, and an annular frustoconical working surface 102 disposed below the arcuate working surface 100. The circular working surface 98 includes a U-shaped annular recess 103 disposed near the arcuate working surface 100. The diameter F" of the circular working surface 98 of the die core 90 is equal to the diameter D" of the center panel 12" of the reformed shell 10".

The punch 92 includes a central circular working surface 104 and an annular downwardly projecting nose 106 around the periphery thereof. The downwardly projecting nose 106 includes an outer working surface 108, an inner working surface 110 and an arcuate bottom working surface 112 having a radius R9. The downwardly projecting nose 106 also includes a flat angled segment 114 positioned radially inward from the inner working surface 110, integrally connecting the inner working surface 110 and the circular working surface 104 of the punch 92. The inner working surface 110 and the angled segment 114 of the downwardly projecting nose 106 are adapted to provide a slight recess 116 between the upper surface of the inner wall 30" and the punch 92.

The outer working surface 108 of the downwardly projecting nose 106 engages a portion of the upper surface of the outer wall 32" of the reformed shell 10" slightly above the countersink bottom 34". The annular die ring 94 engages a portion of the bottom surface of the outer wall 32".

Accordingly, the second punch 92 and die 90, similar to the first punch 48 and die 46, cooperate to grip and hold a portion 78' of the outer wall 32" of the reformed shell 10" fixedly in place between the annular die ring 94 and the outer working surface 108 of the downwardly projecting nose 106.

The die core 96, which engages the bottom surface of the reformed shell 10" radially inward from the countersink bottom 34", is then moved upward in relation to the annular die ring 94 and punch 92. This forces the reformed countersink bottom 34" to wrap, or bend, around the bottom working surface 112 of the downwardly projecting nose 106 and forces a portion of the inner wall 30" against the inner surface 110.

As the die core 96 completes its upward movement, a portion of the shoulder 36" of the reformed shell 10" is brought into contact with the flat angled segment 114 of the punch 92. This contact forces metal in the shoulder 36" to flow both radially inwardly and radially outwardly from the shoulder 36". The recesses 116 and 103 are provided to accommodate for the extra metal flowing from the shoulder 36". Accordingly, the gauge in an annular segment on the shoulder 36 of the completed container end 10 is thinner than the rest of the container end 10.

The second reforming operation, by forcing the countersink bottom 34" to wrap around the downwardly projecting nose 106, reforms metal in the countersink bottom 34" into the inner wall 30". This causes the panel height B" to increase and the countersink depth A" to decrease. According to one aspect of the invention, the panel height B" is increased until it is greater than the initial panel height B' of the shell 10'.

The second reforming operation further decreases the distance between the inner and outer walls 30", 32". It also positions the inner wall 30" to a more vertical position corresponding to the slight frustoconical surface 102 of the die core 96. This further decreases the angle $\alpha$ between the inner wall 30" and the outer wall 32" and the angle $\beta$ between the inner wall 30" and the axis.

The countersink bottom 34 of the container end 10 is formed to have a radius R1 corresponding to the radius R9 of the bottom working surface 112 of the downwardly projecting nose 106.

While the specific embodiments have been illustrated and described, numerous modifications come to mind without significantly departing from the spirit of the invention and the scope of protection is only limited by the scope of the accompanying claims.

What we claim is:

1. A method of producing a container end comprising:

providing a shell having a center panel including an initial panel height and an initial panel diameter, an integral first countersink portion including an initial countersink depth, an inner wall and an outer wall being joined by a curved countersink bottom having a first bottom radius, said panel being joined to the inner wall of the countersink portion by a curved shoulder having an initial shoulder radius, said outer wall being joined to a peripheral curl having an initial curl diameter; and restraining a portion of said outer wall and reforming said first countersink portion to a second countersink portion in a first operation to decrease said first bottom radius to a second bottom radius while maintaining said initial curl diameter; and restraining said portion of said outer wall and reforming said second countersink portion to a third countersink portion in a second operation to decrease said second bottom radius to a third bottom radius while maintaining said initial curl diameter.

2. The method of claim 1, wherein said countersink portion is further reformed to have about a 0.01" radius.

3. The method of claim 1, wherein said second countersink portion is reformed from said first countersink portion and an unrestrained portion of said outer wall.

4. The method of claim 3, wherein said third countersink portion is reformed from said second countersink portion.

* * * * *